US010325585B2

(12) United States Patent
Baker et al.

(10) Patent No.: US 10,325,585 B2
(45) **Date of Patent: *Jun. 18, 2019**

(54) REAL-TIME AUDIO PROCESSING OF AMBIENT SOUND

(71) Applicant: Dolby Laboratories Licensing Corporation, San Francisco, CA (US)

(72) Inventors: Jeffrey Baker, Newbury Park, CA (US); Anthony Parks, Queens, NY (US); Sal Gregory Garcia, Camarillo, CA (US); Thomas Ezekiel Burgess, North Hollywood, CA (US); Matthew Fumio Yamamoto, Moorpark, CA (US); Nils Jacob Palmborg, Emeryville, CA (US); Noah Kraft, Brooklyn, NY (US); Richard Fritz Lanman, III, San Francisco, CA (US); Daniel C. Wiggins, Montecito, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/383,134

(22) Filed: Dec. 19, 2016

(65) Prior Publication Data

US 2017/0103745 A1 Apr. 13, 2017

Related U.S. Application Data

(63) Continuation of application No. 14/727,860, filed on Jun. 1, 2015, now Pat. No. 9,565,491.

(51) Int. Cl.

| | |
|---|---|
| ***H04R 1/10*** | (2006.01) |
| ***H04R 3/00*** | (2006.01) |
| ***G10K 11/178*** | (2006.01) |

(52) U.S. Cl.
CPC ..... *G10K 11/178* (2013.01); *G10K 11/17881* (2018.01); *H04R 1/1083* (2013.01); (Continued)

(58) Field of Classification Search
CPC .. H04R 3/02; H04R 2499/13; H04R 2460/01; H04R 1/1083; H04R 3/005; H03F 3/181; (Continued)

(56) References Cited

U.S. PATENT DOCUMENTS 3,415,246 A * 12/1968 Hill ..... A61F 11/08 128/864
4,985,925 A * 1/1991 Langberg ..... G10K 11/1788 381/71.13

(Continued)

*Primary Examiner* — Davetta W Goins
*Assistant Examiner* — Kuassi A Ganmavo

(57) ABSTRACT

Ambient sound is converted into digital signals. A processor performs active noise cancellation and/or a transformation operation that is distinct from the active noise cancellation on the digital signals. The active noise cancellation and the transformation operation transform the digital signals into modified digital signals. The modified digital signals are converted into modified analog signals. The modified analog signals are outputted as audio waves. An interior microphone is configured to output an output signal to the processor in response to receiving the modified analog signals. In response to receiving the output signal from the interior microphone, the processor is configured to determine whether the modified digital signals produce desired audio waves.

20 Claims, 7 Drawing Sheets

(52) U.S. Cl.
CPC ..... *H04R 3/002* (2013.01); *G10K 2210/1081* (2013.01); *G10K 2210/3026* (2013.01); *G10K 2210/3033* (2013.01); *G10K 2210/3035* (2013.01); *G10K 2210/3044* (2013.01); *G10K 2210/3055* (2013.01); *G10K 2210/504* (2013.01); *H04R 3/005* (2013.01); *H04R 2410/05* (2013.01); *H04R 2460/01* (2013.01)

(58) Field of Classification Search
CPC ..... H04S 5/00; H04W 4/043; H04W 4/02; G10K 2210/108; G10K 2210/125; G10K 2210/509; G10K 2210/3217; G10K 2210/3229
See application file for complete search history.

(56) References Cited

U.S. PATENT DOCUMENTS 5,524,058 A * 6/1996 Moseley ..... A42B 3/30 381/71.6
5,815,582 A * 9/1998 Claybaugh ..... G10K 11/1784 381/71.6
6,091,824 A * 7/2000 Lin ..... G10H 1/0091 381/63
7,541,536 B2 * 6/2009 Daniel ..... G10H 1/053 84/626
2005/0063552 A1 * 3/2005 Shuttleworth ..... H03G 3/32 381/57
2005/0276421 A1 * 12/2005 Bergeron ..... G10K 11/178 381/71.6
2009/0147966 A1 * 6/2009 McIntosh ..... H04R 3/005 381/71.11
2011/0007907 A1 * 1/2011 Park ..... G10K 11/178 381/71.8
2011/0158420 A1 6/2011 Hannah
2012/0020502 A1 * 1/2012 Adams ..... H04S 7/304 381/310
2014/0044269 A1 * 2/2014 Anderson ..... H04R 5/04 381/57
2014/0079235 A1 * 3/2014 Lyons ..... G10K 11/178 381/71.6
2014/0126733 A1 * 5/2014 Gauger, Jr. ..... G10K 11/178 381/71.6
2014/0270200 A1 * 9/2014 Usher ..... H04R 1/1041 381/57
2015/0195641 A1 * 7/2015 Di Censo ..... H04R 1/1083 381/71.6
2015/0222977 A1 * 8/2015 Angel, Jr. ..... H04R 1/105 381/74
2015/0230033 A1 * 8/2015 Sprague ..... H04R 25/604 381/313
2015/0294662 A1 * 10/2015 Ibrahim ..... G10K 11/178 381/71.6

* cited by examiner

REAL-TIME AUDIO PROCESSING OF AMBIENT SOUND

CROSS REFERENCE TO OTHER APPLICATIONS

This application is a continuation of co-pending U.S. patent application Ser. No. 14/727,860 entitled REAL-TIME AUDIO PROCESSING OF AMBIENT SOUND filed Jun. 1, 2015 which is incorporated herein by reference for all purposes.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to real-time audio processing of ambient sound.

Description of the Related Art

The world can be abusively loud, filled with noises one wants to hear mixed with sounds one does wish to hear. For example, a neighbor's baby can be crying while a sports finals game is live on television. The droning hum of an airliner engine can run while you wish to have a conversation with your nearby child. Cities are filled with sirens, subway screeches, and a constant onslaught of traffic. Environments we choose to immerse ourselves in, such as concerts and sports stadia, can be loud enough to induce permanent hearing damage in mere minutes. Prevention of these sounds is at best inconvenient and at worst impossible. There is no audio analog to sunglasses, with which users can easily and selectively shield their ears from unwanted sounds as desired.

Different approaches to deal with either too much audio or too little audio (or the two intermixed) have been devised over time. These include ear plugs, active noise cancellation (ANC), hearing aids and other, similar devices. However all of these approaches have shortcomings.

Ear plugs are more like blinders than sunglasses—they reduce (or completely remove) and muddy our audio experience too far to be enjoyable. ANC, available in many headphones and ear buds, is also a step in the right direction. But it is binary-either all the way on, or all the way off. And ANC is non-selective; it attempts to remove all sounds equally, regardless of their desirability. Both ear plugs and ANC do not discriminate between a background annoyance and a conversation you wish to have.

Hearing aid technology typically provides audio augmentation by increasing the volume of all audio received. More capable hearing aids provide some capability to increase or decrease the volume of certain frequencies. As the focus of hearing aids is typically being able to hear for comprehension of conversation with loved-ones, this is ideal. Particularly sophisticated hearing aids can be tuned to address hearing loss in specific frequency ranges. However, hearing aids typically provide no real, immediate capability to control what aspects, if any, of audio a wearer wishes to hear.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

This patent describes an earpiece, which uses a combination of active cancellation and passive attenuation to create the deepest difference between ambient sound and the ear canal. But this method of creating silence is only a starting point. This difference between inside and outside is a headroom that can be altered, shaped, filtered, and tweaked into a new signal that can be let through to the ear canal. The earpiece acts as an individually controlled filter that enables the user to transform desired and undesired sounds as he or she chooses. In the controlled space that is the difference between the exterior ambient sound and silence, various filters and effects may be applied to transform the sound of ambient sound before it is output to a wearer's ear. Thus, this earpiece may be used for real-time audio processing of ambient sound.

Description of Apparatus

Figure 1:
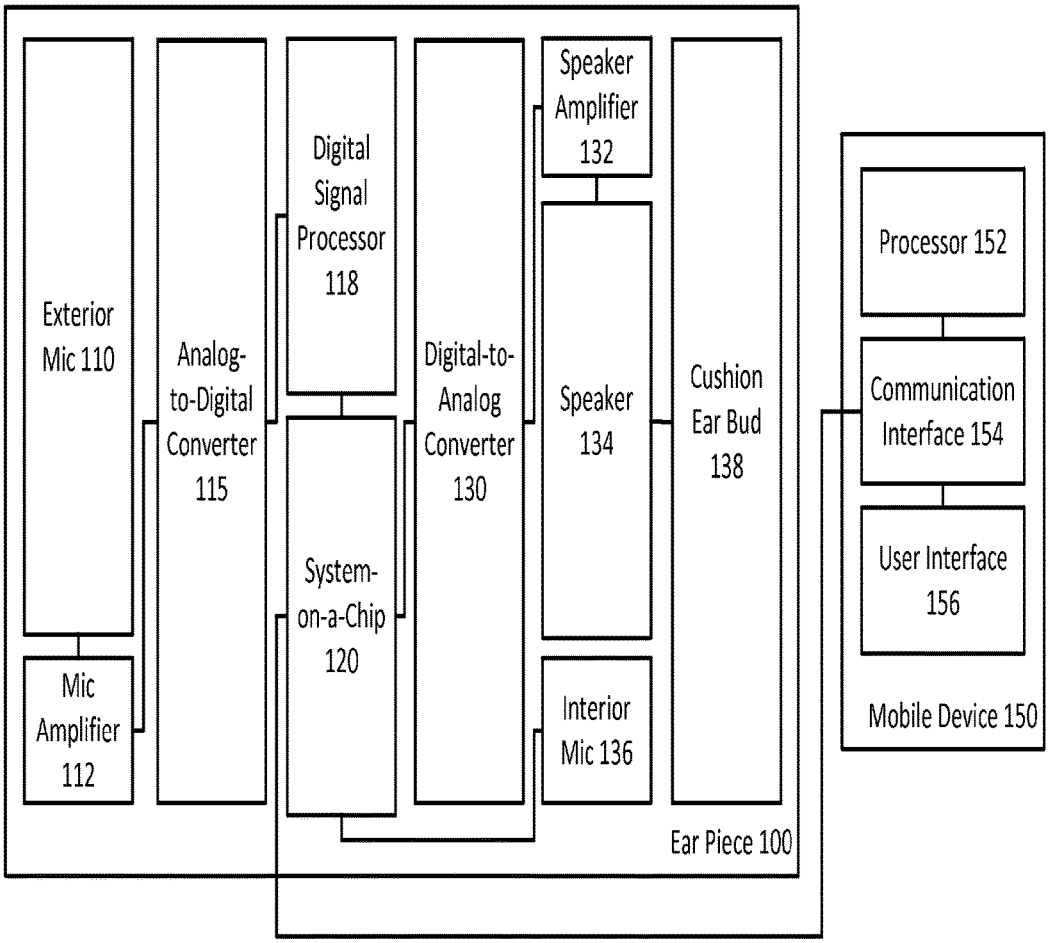
FIG. 1 is a depiction of a system for real-time audio processing of ambient sound.

Referring now to FIG. 1, is a depiction of a system for real-time audio processing of ambient sound is shown. The system includes an ear piece 100 and a mobile device 150. These may be connected by a wireless network, such as a Bluetooth® or near field wireless connection (NFC). Alternatively a wire may be used to connect the mobile device 150 to the ear piece 100. In most cases, two ear pieces 100 will be provided, one for each ear. However, because the systems and functions of both are substantially identical, only one is shown in FIG. 1.

The ear piece 100 includes an exterior mic 110, a mic amplifier 112, an analog-to-digital converter (ADC) 115, a digital signal processor 118, a system-on-a-chip (SOC) 120, a digital-to-analog converter (DAC) 130, a speaker amplifier 132, a speaker 134, an interior mic 136, and a cushion ear bud 138. The mobile device 150 includes a processor 152, a communications interface 154, and a user interface 156. Throughout this patent, the word "mic" is used in place of microphone—a device for detecting sound and converting it into analog electrical signals.

The exterior mic 110 receives ambient sound from the exterior of the ear piece 100. When in use, the exterior mic 110 is positioned within or immediately outside of the ear canal of a wearer. This enables two of the exterior mic 110, one in each of the two ear pieces 100, to provide one part of stereo and spatial audio for a wearer of both. Positioning a single exterior mic 110 or multiple mics in locations other than near or in the wearer's ears causes the spatial perception of human hearing and auditory processing to cease to function or to function more poorly. As a result, systems that utilize a single microphone or utilize microphones not placed within or immediately outside the ear canal of a wearer do not function well, particularly for processing ambient sound. In some cases, such as the use of a digital mic, the analog-to-digital converter 115 and mic amplifier 112 may be integral to the exterior mic 136.

As used herein, the term "ambient sound" means external audio generally available in a physical location. Ambient sound explicitly excludes pre-recorded audio or the playback of pre-recorded audio in any form.

As used herein, the term "real-time" means that a process occurs in a time frame of less than thirty milliseconds. For example, real-time audio processing of ambient sound, as used herein means that output of modified audio waves based upon external audio generally available in a physical location begins within thirty milliseconds of the ambient sound being received by the exterior mic. For example, for effects that include delays, the primary sound is output within thirty milliseconds, whereas the secondary sound, such as the echo or reverb, may arrive following the thirty milliseconds.

The mic amplifier 112 is connected to the exterior mic 110 and is designed to amplify the analog signal received by the exterior mic 110 so that it may be operated upon by subsequent processing. Using the mic amplifier 112 enables subsequent processing to have a better-defined signal upon which to operate.

The analog-to-digital converter 115 is connected to the exterior mic 110 and mic amplifier 112. The analog-to-digital converter 115 converts the analog electrical signals generated by the exterior mic 110 and amplified by the mic amplifier 112 into digital signals that may be operated upon by a processor. The digital signals created may be pulse-code modulated data that may be transferred, for example, using the $I^2S$ protocol. In some cases, such as the use of a digital mic, the analog-to-digital converter 115 and mic amplifier 112 may be integral to the exterior mic 110.

The digital signal processor 118 is a specialized processor designed for processing digital signals, such as the audio data created by the analog-to-digital converter 115. The digital signal processor 118 may include specific programming and specific instruction sets that are useful or only useful for acting upon digital audio data or signals. There are numerous types of digital signal processors available. Digital signal processors, like digital signal processor 118, may receive instructions from an external processor or may be a part of or an integrated chip with instructions that instruct the digital signal processor 118 in performing operations upon digital signals. Some or all of these instructions may come from the mobile device 150.

The system-on-a-chip 120 may be integrated with, the same as, or a part of a larger chip including the digital signal processor 118. The system-on-a-chip 120 receives instructions, for example from the mobile device 150, and causes the digital signal processor 118 and the system-on-a-chip 120 to function accordingly. Portions of these instructions may be stored on the system-on-a-chip 120. For example, these instructions may be as simple as lowering the volume of the speaker 134 or may involve more complex operations, as discussed below. The system-on-a-chip 120 may be a fully-integrated single-chip (or multi-chip) computing device complete with embedded memory, long-term storage, communications interface(s) and input/output interface(s).

The system-on-a-chip 120, digital signal processor 118, analog-to-digital converter 115, and digital-to-analog converter 130 (discussed below) may each be a part of a single physical chip or a set of interconnected chips. Some or all of the functions of the digital signal processor 118, the analog-to-digital converter 115, and the digital-to-analog converter 130 may be implemented as instructions executed by the system-on-a-chip 120. Preferably, each of these elements is implemented as a single, integrated chip, but may also be implemented as independent, interconnected physical devices. The system-on-a-chip 120 may be capable of wired or wireless communication, for example, with the mobile device 150.

The digital-to-analog converter 130 receives digital signals, like those created by the analog-to-digital converter 115 and operated upon by the digital signal processor 118 into analog electrical signals that may be received and output by a speaker, like speaker 134.

The speaker amplifier 132 receives analog electrical signals from the digital-to-analog converter 130 and amplifies those signals to better conform to levels expected by the speaker 134 for subsequent output.

The speaker 134 receives analog electrical signals from the digital-to-analog converter 130 and the speaker amplifier 132 and outputs those signals as audio waves.

The interior mic 136 is interior to the portion of the earpiece housing 100 that extends into a wearer's ear. Specifically, the interior mic 136 is positioned such that it receives audio waves generated by the speaker 134 and, preferably, does not receive much if any exterior audio. The interior mic 136 may rely upon the analog-to-digital converter 115 just as the exterior mic 110. In some cases, such as the use of a digital mic, the analog-to-digital converter 115 and mic amplifier 112 may be integral to the interior mic 136.

The cushion ear bud 138 is a soft ear bud designed to fit snugly, but comfortably within the ear canal of a wearer. The cushion ear bud 138 may be, for example, made of silicone. Multiple sizes of interchangeable cushion ear buds may be provided to suit individuals with varying ear canal shapes and sizes.

The cushion ear bud 138 may be designed in such a way and of such a material that it provides a substantial degree of passive noise attenuation. For example, the cushion ear bud 138 may include a series of baffles in order to provide pockets of air and multiple barriers between the exterior of the ear canal and the interior closed by the cushion ear bud 138. Each pocket of air and barrier provides further passive noise attenuation. Similarly, a silicone ear bud may be thicker than necessary for mere closure in order to provide a more substantial barrier to outside noise or may include an exterior pocket that serves to deaden exterior sound more fully.

Although shown as a cushion ear bud 138, the ear piece 100 may be implemented as an over-the-ear headset. In such a case, the cushion ear bud 138 may, instead, be a cushion around the exterior or substantially the exterior of the speaker 134 that is approximately the size of a wearer's ear.

The mobile device 150 may be, for example, a mobile phone, smart phone, tablet, smart watch, or other, handheld computing device. The mobile device 150 includes a processor 152, a communications interface 154, and a user interface 156. Operating system and other software, such as "apps" may operate upon the processor 152 and generate one or more user interfaces, like user interface 156, through which the mobile device may receive instructions, for example, from a user.

The mobile device 150 may communicate with the system using the communications interface 154. This communications interface 154 may be, for example, wireless such as 802.11x wireless, Bluetooth®, NFC, or other short to medium-range wireless protocols. Alternatively, the communications interface 154 may use wired protocols and connectors of various types such as micro-USB®, or simplified communication protocols enabled through audio wires.

The mobile device 150 may be used to control the operation of the ear piece 100 so as to apply any number of filters and to enable a user to interact with the ear piece 100 to alter its functioning. In this way, the wearer need not interact with the ear piece 100, risking dislodging it from an ear, dropping the ear piece 100, or otherwise interfering with its operation. The process of control by a mobile device, like mobile device 150, is discussed below with reference to FIG. 7.

Figure 2:
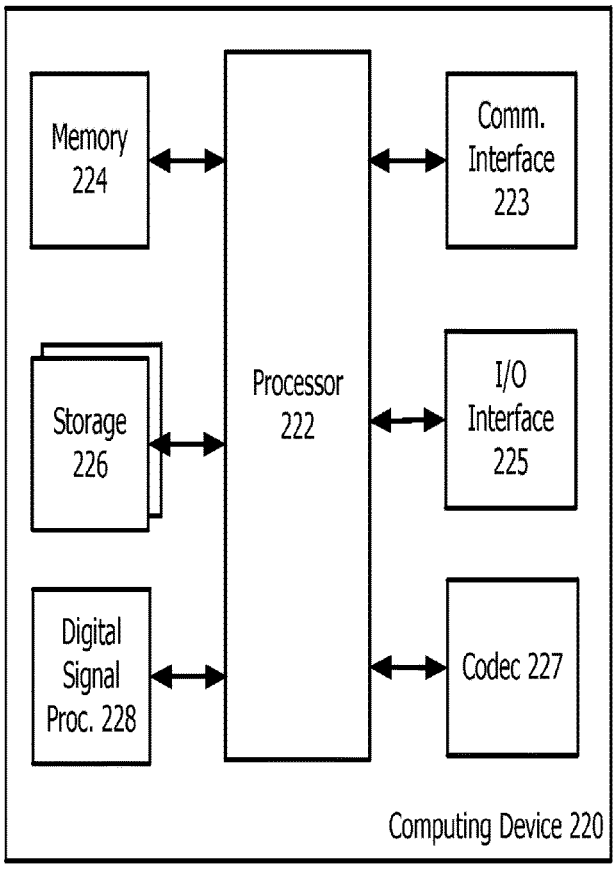
FIG. 2 is a depiction of a computing device.

FIG. 2 is a depiction of a computing device 220. The computing device 220 includes a processor 222, communications interface 223, memory 224, an input/output interface 225, storage 226, a CODEC 227, and a digital signal processor 228. Some of these elements may or may not be present, depending on the implementation. Further, although these elements are shown independently of one another, each may, in some cases, be integrated into another.

The computing device 220 is representative of the system-on-a-chip, mobile devices, and other computing devices discussed herein. For example, the computing device 220 may be or be a part of the digital signal processor 118, the system-on-a-chip 120, the mobile device 150, or the mobile device processor 152 The computing device 220 may include software and/or hardware for providing functionality and features described herein. The computing device 220 may therefore include one or more of: logic arrays, memories, analog circuits, digital circuits, software, firmware and processors. The hardware and firmware components of the computing device 220 may include various specialized units, circuits, software and interfaces for providing the functionality and features described herein.

The processor 222 may be or include one or more microprocessors, application specific integrated circuits (ASICs), or a system-on-a-chip (SOCs). The processor may, in some cases, be integrated with the CODEC 225 and/or the digital signal processor 228.

The communications interface 223 includes an interface for communicating with external devices. In the case of a computing device 220 like the system-on-a-chip 120, the communications interface 223 may enable wireless communication with the mobile device 150. In the case of a computing device 220 like the mobile device 150 the communication interface 223 may enable wireless communication with the system-on-a-chip 120. The communications interface 221 may be wired or wireless. The communications interface 221 may rely upon short to medium range wireless protocols as discussed above.

The memory 224 may be or include RAM, ROM, DRAM, SRAM and MRAM, and may include firmware, such as static data or fixed instructions, boot code, system functions, configuration data, and other routines used during the operation of the computing device 220 and processor 222. The memory 224 also provides a storage area for data and instructions associated with applications and data handled by the processor 222. In some implementations, particularly those reliant upon a single integrated chip, there may be no real distinction between memory 224 and storage 226 (discussed below). For example, both memory 224 and storage 226 may utilize one or more addressable portions of a single NAND-based flash memory.

The I/O interface 225 interfaces the processor 222 to components external to the computing device 220. In the case of servers and mobile devices, these may be keyboards, mice, and other peripherals. In the case of the system-on-a-chip 120, these may be components of the system such as the digital-to-analog converter 130, the digital signal processor 118, and the analog-to-digital converter 115 (see FIG. 1).

The storage 226 provides non-volatile, bulk or long term storage of data or instructions in the computing device 220. The storage 228 may take the form of a disk, NAND-based flash memory or other reasonably high capacity addressable or serial storage medium. Multiple storage devices may be provided or available to the computing device 220. Some of these storage devices may be external to the computing device 220, such as network storage, cloud-based storage, or storage on a related mobile device. For example, storage 226 may be made available to the system-on-a-chip wirelessly, relying upon the communications interface 223, in the mobile device 150. This storage 226 may store some or all of the instructions for the computing device 220. The term "storage medium", as used herein, specifically excludes transitory medium such as propagating waveforms and radio frequency signals.

The CODEC (encoder/decoder) 227 may be included in the computing device 220 as a specialized, integrated processor and associated components that enable operations upon digital audio. The CODEC 227 may be or include mic amplifiers, communications interfaces with other portions of the computing device 220, analog-to-digital converter, a digital-to-analog converter and/or speaker amps. For example, in FIG. 1, the CODEC 227 may be a single integrated chip that includes each of mic amplifier 112, the analog-to-digital converter 115, the digital-to-analog converter 130, and the speaker amplifier 132. As indicated above, the CODEC may be integrated into a single piece of hardware like the system on a chip 120.

The digital signal processor (DSP) 228 may be included in the computing device 220 as an independent, specialized processor designed for operation upon digital audio data, streams or signals. The DSP 228 may, for example, include specific instruction sets and operations that enable real-time, detailed digital operations upon digital audio.

Figure 3:
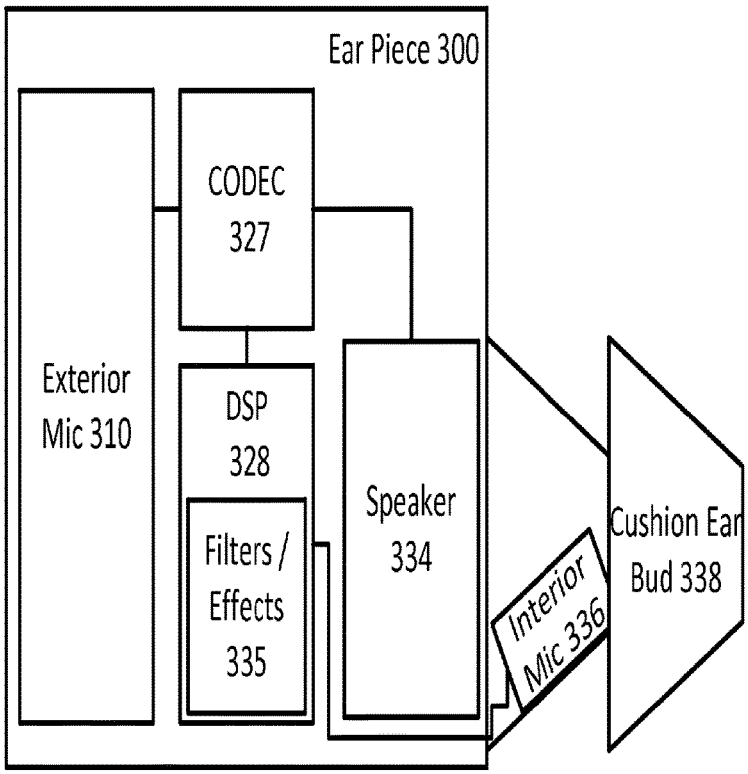
FIG. 3 is a functional diagram of the system for real-time audio processing of ambient sound.

FIG. 3 is a functional diagram of the system for real-time audio processing of ambient sound. The system includes an ear piece housing 300, an exterior mic 310, a CODEC (encoder/decoder) 327 including filters/effects 335, a speaker 334, an interior mic 336, and a cushion ear bud 338.

The earpiece housing 300 encloses and provides protection to an exterior mic 310, the digital signal processor (DSP) 328, the CODEC 327 including filters/effects 335, the speaker 334, the interior mic 336. The cushion ear bud 338 attaches to the exterior of the earpiece housing 300 so that a portion of the earpiece housing 300 may be put in place within the ear canal (or immediately outside the ear canal) of a wearer.

As indicated above, the exterior mic 310 receives ambient audio from the exterior surroundings. The exterior mic 310 as described functionally here may actually include an amplifier, like mic ampiflier 112 above.

The CODEC (encoder/decoder) 327 may be or include a microphone amplifier, an analog-to-digital converter (ADC) 115, a digital-to-analog converter (DAC) 130, and/or a speaker amplifier 132 (FIG. 1). The CODEC 327 may include simple digital or analog audio manipulation capabilities. The CODEC 327 may be integrated with a digital signal processor or a system-on-a-chip.

The digital signal processor (DSP) 328 is a specialized processor designed for operation upon digital audio data, streams, or signals. Functionally, the DSP 328 operates to perform operations on audio in response to instructions from internal programming, such as pre-determined filters/effects 335, that may be stored within the DSP 328 or from external devices such as a mobile device in communication with the DSP 328. These filters/effects 335 may be binary operations or processor instruction sets hard-coded in the DSP 328. Alternatively, the DSP 328 may be programmable such that a base set of processor instruction sets for operation upon digital audio data, streams, or signals may be expanded upon either through user interaction, for example, with a mobile device or through new instructions uploaded from, for example, a mobile device to thereby alter pre-existing filters or to add additional filters/effects 335.

The filters/effects 335 may include filters such as alteration of ambient world volume, reverb, echo, chorus, flange, vinyl, bass boost, equalization (pre-defined or user-controlled), stereo separation, baby noise reduction, digital notch filters, jet engine reduction, crowd reduction, or urban noise reduction. Multiple filters/effects 335 may be applied simultaneously to audio to create multi-effects. These filters/effects 335 may also be referred to as transformations. Although discussed independently, these filters/effects 335 may be applied simultaneously together.

The first of filter /effects 335 is ambient world volume reduction. Ambient world volume may adjust the reproduction volume of received ambient audio such that it is louder or softer than the ambient audio received by the exterior microphone 310. Ambient world volume relies both upon the passive noise attenuation and active noise cancellation to create a large difference between the actual ambient sound and the sound internally reproduced to the ear. The ambient audio is reproduced, in conjunction with active noise cancellation, through the internal speaker 334 at a volume as controlled by a user operating, for example, a mobile device. For example, control of the ambient world volume may be enabled by a physical knob (e.g. on the earpiece) or a "knob-like" user interface element on a mobile device user interface.

Figure 4:
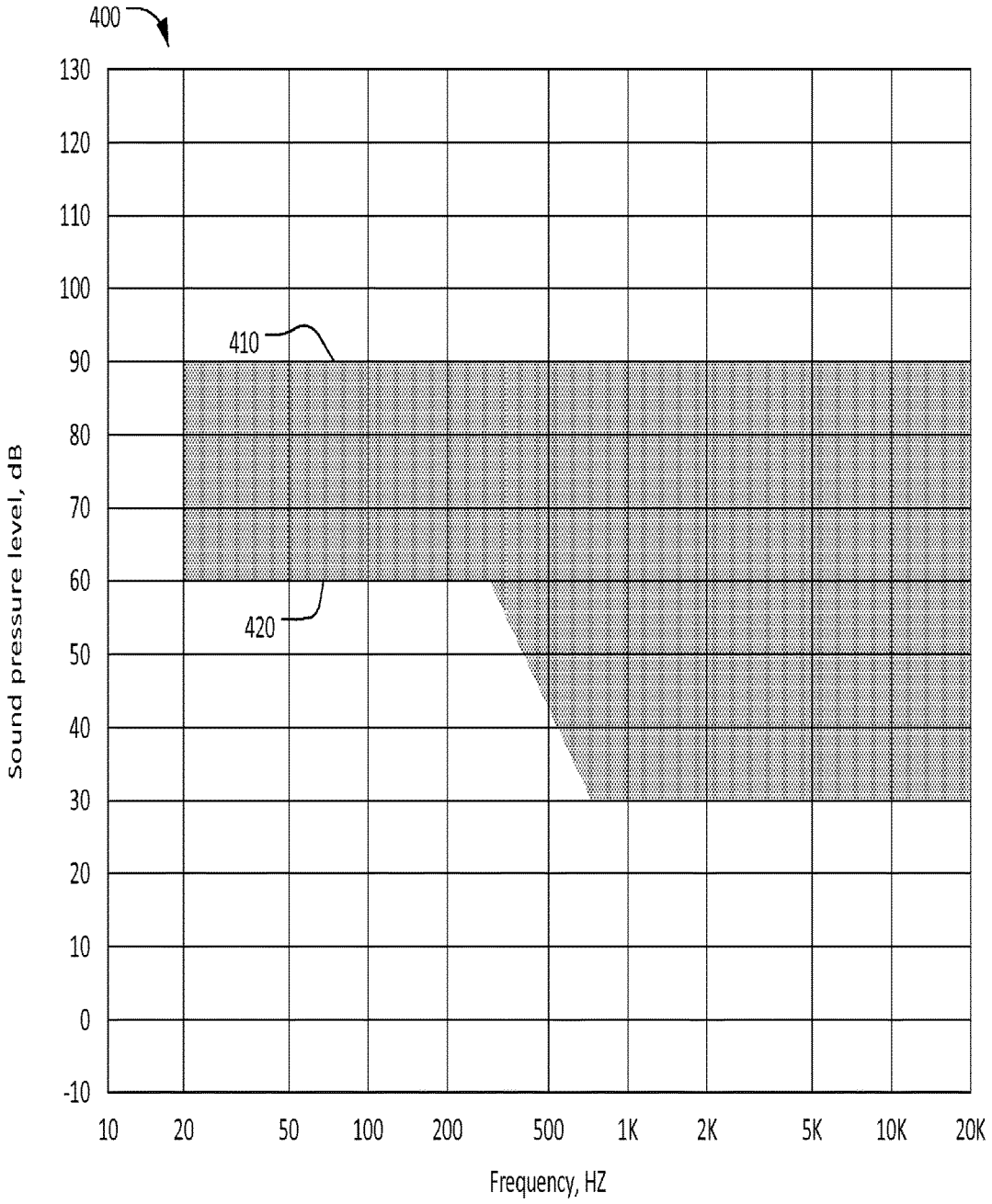
FIG. 4 is a decibel and frequency map showing an example of the space available for ambient world volume reduction and other transformations.

FIG. 4 is a decibel and frequency map showing an example of the space available for ambient world volume reduction and other transformations. The space 400 has an x-axis of frequency in hertz (Hz) and a y-axis of sound pressure in decibels (dB). Ambient sound may have a spectral content, and a certain loudness, represented by the top line 410. At their maximum effectiveness, passive attenuation and active noise cancellation may act together to reduce the sound reaching the ear canal to the spectral content represented by the bottom line 420. The space between these two lines 410, 420 is an aural range available to transformations; by operating on sound received at the exterior mic 110, transforming the corresponding digital signals, then reproducing this sound at the speaker, any sound in the grayed space between top line 410 and bottom line 420 may be produced. If the transformation includes sufficiently high amplification, then sounds above the ambient sound top line 410 may be produced. A transformation may act on all frequencies at once, such as a simple volume knob. Or if a transformation includes frequency shaping such as digital filters, then the transformation may affect one or more frequency ranges independently.

Artificial reverberation AKA reverb, one of the filters/effects 335, employs a series of diffusive, dispersive, and absorptive digital filters to create simulated reflections with decaying amplitude. Reverb is applied continuously and often mixed with a portion of the original input signal. The reverb filter/effect 335 may be activated by a user interacting with a button on a mobile device user interface. A slider may be provided in order to alter the delay and length of application of the reverb.

Echo, another of the filters/effects 335, is a simple building block of reverb with very low echo density that usually does not increase with time. The echo spacing is often 0.25 to 0.75 seconds. The echo filter/effect 335 may be activated by a user interacting with a button on a mobile device user interface. A slider may be provided in order to alter the delay.

Chorus is another of the filters/effects 335. It is created by creating one or more copies of ambient audio, slightly altering the delay time of each copy with a periodic function such as a sine or triangle wave. The average delay time is usually 10 to 40 milliseconds. The chorus filter/effect 335 may be activated by a user interacting with a button on a mobile device user interface. A slider may be provided in order to alter the range of delays available.

Flange is still another of the filters/effects 335. Flange is created by creating one or more copies of ambient audio, slightly altering the delay time of each copy with a periodic function such as a sine or triangle wave. The average delay time is usually 0.1 to 10 milliseconds. The flange filter/effect 335 may be activated by a user interacting with a button on a mobile device user interface.

Vinyl, still another of the filters/effects 335, applies a randomly-determined set of crackle, hiss, and flutter sounds, similar to long play vinyl records, to ambient sound. The crackle, hiss and flutter sounds can be randomly applied to ambient audio at random intervals. A slider may be provided on a mobile device user interface whereby a user can select a younger or older vinyl. Selecting an older vinyl may increase the interval at which crackle, hiss, and flutter sounds are randomly applied in order to simulate an older, more-worn vinyl recording. The vinyl filter/effect 335 may be activated by a user interacting with a button on a mobile device user interface.

Bass boost is another of the filters/effects 335 that increases frequencies in the human hearable bass range, approximately 20 Hz to 320 Hz. The bass boost filter/effect 335 may be activated by a user interacting with a button on a mobile device user interface.

Another of the filters/effects 335 is equalization. Equalization increases or decreases frequency bands as directed by a mobile device for example, under the control of a user. An associated transformation operation may include the application of at least one filter that increases the volume of audio within at least one preselected frequency band. An example user interface may show sliders for each preselected frequency band that may be altered through user interaction with the slider to increase or decrease the volume of the frequency band.

Stereo separation, yet another of the filters/effects 335, requires two earpieces, one in each ear, and the ambient sound received may be modified such that it appears to be coming, spatially, from a further and further distance or a spatially different location relative to its actual location in the physical world. The stereo separation filter/effect 335 may be activated by a user interacting with a slider on a mobile device user interface that increases and decreases the "separation."

A notch filter is still another of the filters/effects 335 that reduces the volume of one or more frequency bands in the ambient audio. The notch filter may be applied in various contexts, to eliminate particular frequencies or groupings of frequencies as discussed more fully below with reference to baby reduction, crowd reduction, and urban noise. A notch filter may be activated, for example, using a user interface button or series of buttons on a mobile device display.

The baby reduction filter/effect 335 uses a digital signal processor to identify frequencies and characteristics (harmonic signal with fundamental signal often in range 300 to 600 Hz, a not particularly percussive start, a sustain of over a second punctuated by a drop in pitch and level) associated with a baby crying, then attempts to counteract those pitch-tracking filters for those identified frequencies and characteristics. The baby reduction filter/effect 335 may be activated by a user interacting with a button on a mobile device user interface.

The crowd reduction filter/effect 335 uses a digital signal processor to identify frequencies and characteristics associated with a crowds and human groups, then attempts to counteract those frequencies and characteristics using a combination of active noise cancellation and other noise reduction technology. The crowd reduction filter/effect 335 may be activated by a user interacting with a button on a mobile device user interface.

The urban noise filter/effect 335 uses a digital signal processor to identify frequencies and characteristics associated with sirens, subway noise, and sirens, then attempts to counteract those frequencies and characteristics using a combination of active noise cancellation and other noise reduction technology. The urban noise filter/effect 335 may be activated by a user interacting with a button on a mobile device user interface.

The speaker 334 outputs the modified ambient audio, as transformed by the DSP 328 and including any filters/effects 335 applied to the ambient audio.

The interior mic 336 receives the audio output by the speaker 334 and produces analog audio signals that may be converted back into digital signals for analysis by the DSP 328. These signals may be analyzed to determine if the volume, frequencies, or filters/effects 335 are applied in an expected way.

The interior mic 336 may also evaluate the effectiveness of the active noise cancellation by determining those frequencies that are received both by the exterior mic 310 and the interior mic 336 and providing feedback to the DSP 328 in how to better counter the ambient noise by providing feedback that identifies the ambient sounds being heard by a wearer. Adaptivity of the active noise cancellation may be provided by LMS (least-mean-squares) and FxLMS algorithms. Active noise cancellation relies upon counteractive frequencies generated in contraposition to ambient sound. These frequencies serve to "cancel" the undesired frequencies and to quiet the noise of the selected exterior frequencies.

Active cancellation is distinct from passive attenuation in that it counteracts undesired ambient sounds by producing sound waves that destructively interfere with ambient sound waves. Passive attenuation, in contrast, relies on material properties (mass and elasticity) to dampen sound waves. In the present system, active noise cancellation and passive attenuation are used to remove as much of the ambient sound as possible. Thereafter, some of this ambient sound, after transformation, can be digitally reproduced by the interior speaker exterior mic 334.

The cushion ear bud 338 creates a seal of the ear canal that provides passive noise attenuation. The ear piece 100 itself, including its materials and design may also provide passive noise attenuation.

Description of Processes

Figure 5:
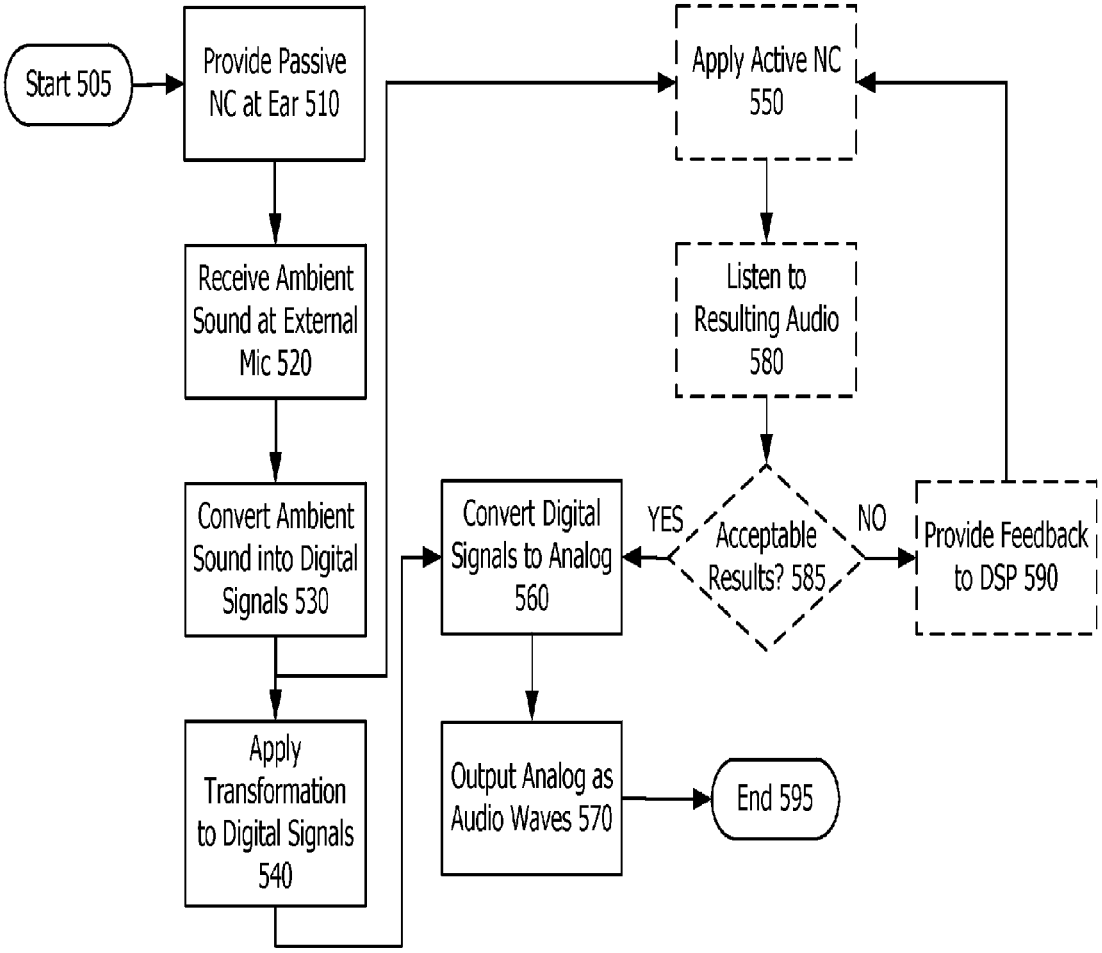
FIG. 5 is a flowchart of the process of real-time audio processing of ambient sound.

Referring now to FIG. 5 is a flowchart of the process of real-time audio processing of ambient sound. The flow chart has both a start 505 and an end 595, but the process is cyclical in nature. Indeed, the process preferably occurs continuously, once the ear pieces are powered on, to convert ambient audio into modified ambient audio that is output by the internal speakers for a wearer to hear.

The process begins after start 505 with the insertion of the earpiece into an ear that provides passive noise attenuation to an ear 510. Preferably, two earpieces will be provided so that the passive noise attenuation can fully function. The passive noise attenuation blocks some portion of ambient audio.

Next, ambient sound is received at the exterior mic 110 at 520. The ambient sound may be, for example, audio from individuals speaking, an airplane noise, a concert including both the music and crowd noise, or virtually any other kind of ambient audio. The ambient sound will in most cases be a mixture of desirable audio (e.g. the music at a concert, or family member's voices at a restaurant) and undesirable audio (e.g. voices of the crowd, background noise and kitchen noises). The exterior mic 110 receives sounds and converts them into electrical signals.

Next, the ambient sound (in the form of electrical signals) is converted into digital signals at 530. This may be accomplished by the analog-to-digital converter 115. The conversion changes the electrical signals into digital signals that may be operated upon by a digital signal processor, such as digital signal processor 118, or more general purpose processors.

Next transformations are applied to the digital signals at 540. These transformations may be, for example, the filters/effects 335 identified above. These filters/effects 335 are applied to the digital signals which causes sound produced from those signals to be altered as-directed by the transformation.

Substantially simultaneously with the application of transformations to digital signals at 540, preferably on a dedicated, direct, low-latency active noise cancellation processing pathway, the digital signals representative of the ambient audio are transmitted to the digital signal processor 118. This process is shown in dashed lines because it may not be implemented in some cases or may selectively be implemented. If applied, the active noise cancellation is, in effect, a high-speed transformation performed on the digital signals to further alter the audio received as the ambient sound.

The system may further listen to the resulting audio at 580. The interior mic 336 may perform this function so that it can provide real-time feedback to the digital signal processor 118 as to the overall quality of the active noise cancellation applied at 450. If adjustments are necessary, the active noise cancellation parameters may be adjusted and optimized going forward in response to additional information received by the interior mic 136 This step is also presented in dashed lines because it may not be implemented in some cases.

The digital signal processor 118 may make a determination, based upon the audio received by the interior mic 136 (FIG. 1), whether the results are acceptable at 485. This determination may particularly focus on the application of active noise cancellation or the quality of a particular transformation performed at 540.

If the results are not acceptable (not at 585), then feedback may be provided to the DSP 328 at 5. In response, the transformation parameters may be modified based upon the results. For example, if additional undesired frequencies appear in the audio received by the interior mic 336 (FIG. 3), noise cancellation may be modified to compensate for those additional undesired frequencies.

The feedback provided at 590 may be used to update the active noise cancellation applied at 550. In this way, active noise cancellation being applied may be dynamically updated to better counteract the present ambient audio. Based upon the audio waves received by the interior mic 336 and transmitted to the digital signal processor 328, the active noise cancellation may continuously adapt.

Next, the modified digital signals, including any active noise cancellation, are converted to analog at 560. This is to enable the modified digital signals to be output by a speaker into the ears of a wearer.

The modified analog electrical signals are then output as audio waves by, for example, the speaker 334, at 570.

After the sound is output at 570, the process ends at 595. The process takes place continuously. The process may in fact be at various steps of completion for received audio while the system is functioning.

Figure 6:
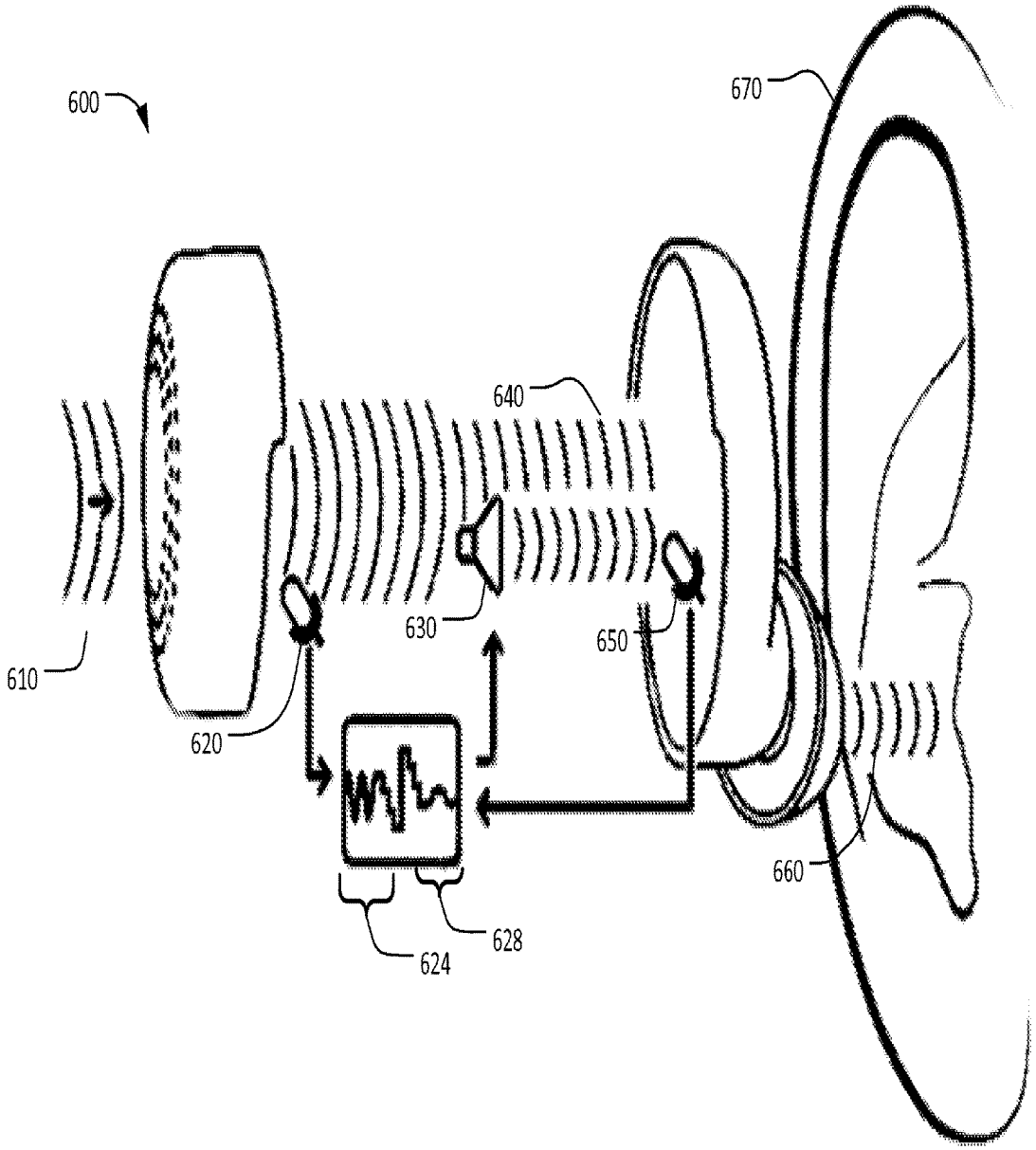
FIG. 6 is a visual depiction of the process of real-time audio processing of ambient sound.

FIG. 6 is a visual depiction of the process 600 of real-time audio processing of ambient sound. The process 600 begins with the ambient sound 610 that is received by the exterior mic 620. The ambient audio 610 is then converted into a digital signal 624 which may be modified into the modified digital signal 628. The internal speaker 630 may then output the modified audio waves 640. These modified audio waves 640 may be received both by the interior mic 650 in order to provide feedback to the system and as modified audio waves 660 by the wearer's ear 670.

Figure 7:
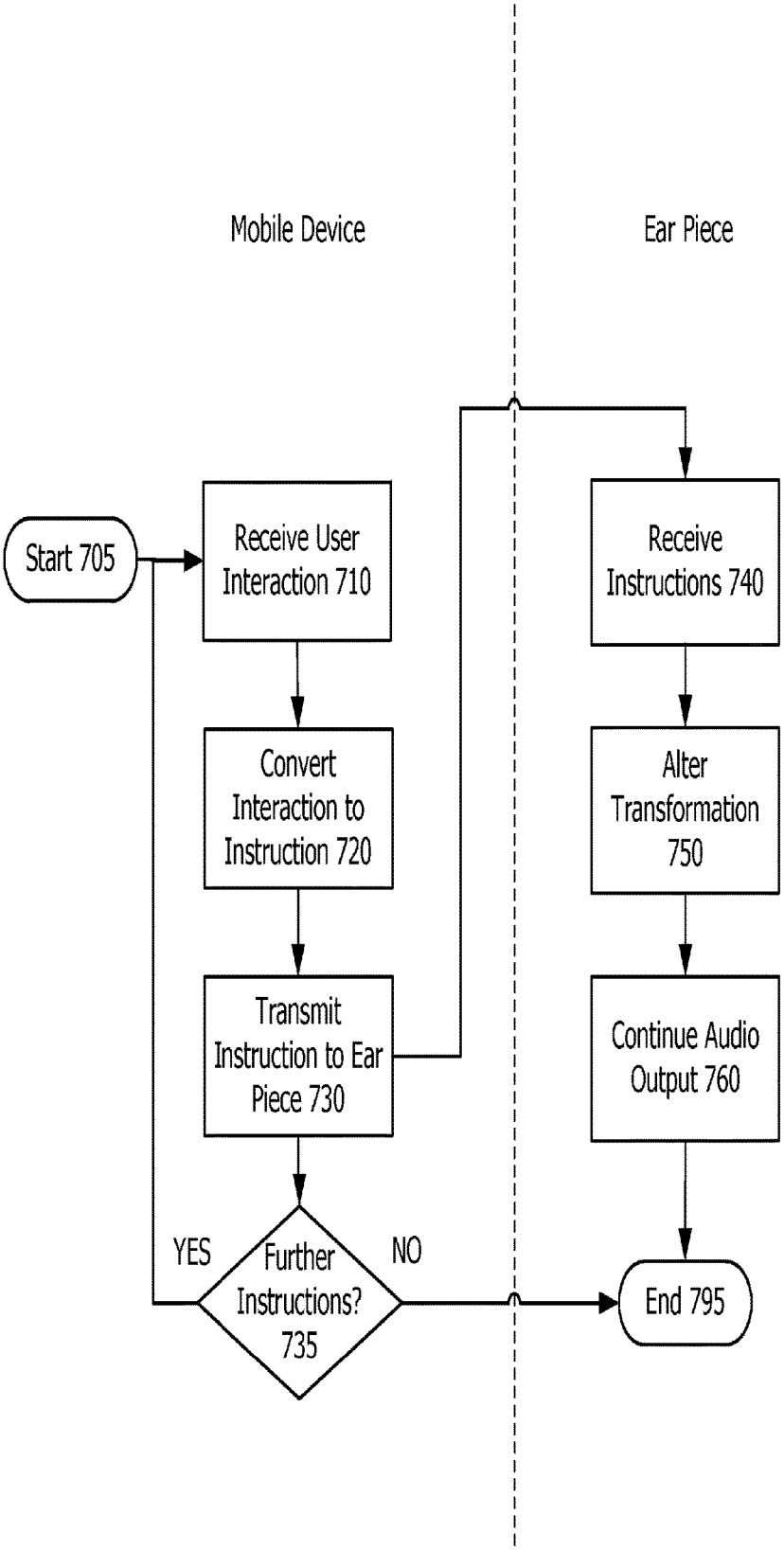
FIG. 7 is a flowchart of the process of using a mobile device to provide instructions to an earpiece regarding real-time audio processing of ambient sound.

FIG. 7 is a flowchart of the process of using a mobile device, such as mobile device 150, to provide instructions to an earpiece regarding real-time audio processing of ambient sound. The flow chart has both a start 705 and an end 795, but the process may indefinitely repeatable in nature. Indeed, the process preferably occurs continuously, once the ear pieces are powered on and a mobile application on the mobile device 150 is powered on, to enable users to interact with the ear piece 100 (FIG. 1).

The process begins after start 705 with the receipt of user interaction at 710. This interaction may be a user altering a setting on a slider or pressing a button associated with one of the filters/effects 335 (FIG. 3) or may be interaction with a volume knob associated with ambient world volume or the volume of a particular frequency. These interactions may occur, for example, through visual representations of familiar physical analogs on a user interface, like user interface 156 (FIG. 1). This user interface 156 may be implemented as a mobile device application or "app."

After user interaction is received at 710, the data generated or settings altered by that user interaction are converted into instructions at 720. These instructions may be complex, such as numerical settings or algorithms to apply to the ambient audio as a part of the application of a filter/effect 335 (FIG. 3). Alternatively, these instructions may merely be a command or function call that indicates that a particular specialized registry in the digital signal processor 118 or system-on-a-chip 120 (FIG. 1) should be set to a particular value or that a particular instruction set should be executed until otherwise turned off. Converting the instructions at 720 prepares them for transmission to the earpiece for execution.

Next, the instructions are transmitted to the ear piece at 730. This transmission preferably takes place wirelessly, between, for example, the communications interface 154 of the mobile device and the system-on-a-chip 120 (or digital signal processor 118) (FIG. 1). The mobile device 150 and ear piece 100 may communicate, for example, by Bluetooth®, NFC or other, similar, short to medium-range wireless protocols. Alternatively, some form of wired protocol may also be employed.

Further instructions are awaited at 735, even as the instructions are transmitted at 730. Subsequent interaction may be received, restarting the process at 710.

The instructions are then received at the ear piece 100 at 740. As indicated above, these instructions may be simple and may correspond to altering a state from "on" to "off" or may simply set a variable such as a volume or frequency-related filter to a different numerical setting. The change may be complex making multiple changes to various settings within the ear piece 100.

After the instructions are received at 740, the transformations taking place using the ear piece are altered at 750. Because the ear piece 100 is continuously processing ambient audio while powered on and worn by a user, it never ceases performing the most-recently requested transformations. Once new instructions are received, the transformations are merely altered and the process of transforming the ambient audio continues with the new settings at 760.

Once the new settings are implemented and audio output is continued using the new settings at 760, the process ends at 795. Further interactions at 710, and instructions at 740 may be received by the mobile device 150 and the ear piece 100. These will merely restart the flowchart show in FIG. 7.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or"

means that the listed items are alternatives, but the alternatives also include any combination of the listed items.

What is claimed is:

1. A system, comprising:

an ear piece configured to convert ambient sound into digital signals, wherein the ambient sound spans an audible frequency range and the ambient sound having an ambient sound pressure level, and wherein the ear piece includes an exterior microphone, an interior microphone, and a cushion that includes a series of baffles configured to provide passive noise attenuation;

a communications interface configured to communicate with a mobile device; and a processor coupled to the exterior microphone and the interior microphone, wherein the processor is configured to perform active noise cancellation and/or one or more transformation operations that are distinct from the active noise cancellation on the digital signals, wherein the active noise cancellation and the one or more transformation operations transform the digital signals into modified digital signals, wherein in the event the active noise cancellation is performed on the digital signals the modified digital signals have a noise cancellation sound pressure level, wherein the noise cancellation sound pressure level spans the audible frequency range and the noise cancellation sound pressure level is less than the ambient sound pressure level, wherein the noise cancellation sound pressure level is based on the passive noise attenuation provided by the cushion and active noise cancellation provided by the processor, wherein in the event one of the one or more transformation operations is performed on the digital signals, the modified digital signals have an associated sound pressure level that spans the audible frequency range and the associated sound pressure level is less than the ambient sound pressure level and higher than the noise cancellation sound pressure level, wherein the ear piece is configured to convert the modified digital signals into modified analog signals and output the modified analog signals as audio waves, wherein the interior microphone is configured to output an output signal in response to receiving the modified analog signals, wherein in response to receiving the output signal from the interior microphone, the processor is configured to determine whether the modified digital signals produce desired audio waves and to continuously adapt the active noise cancellation and a parameter of the one or more transformation operations according to a result of the active noise cancellation and a quality of the one or more transformation operations, wherein the communications interface is configured to receive, from the mobile device, a first user selection that corresponds to selecting the one of the one or more transformation operations, wherein the communications interface is configured to receive, from the mobile device, a second user selection that corresponds to altering a selected parameter of the first user selection.

2. The system of claim 1, wherein a transformation operation is at least one of:

adding digital reverb to the digital signals;

applying an echo to the digital signals;

applying a digital notch filter; and applying a flange to mix two copies of the digital signals, wherein a second copy of the digital signals includes a delay between 0.1 and 10 milliseconds relative to a first copy of the digital signals.

3. The system of claim 1, wherein the active noise cancellation is designed to reduce noise in a specific frequency range associated with a selected one of background noise at a concert, background noise at a stadium, noise other than those by musicians during musical performance, and noise from a crying baby.

4. The system of claim 1, wherein a transformation operation is an application of at least one filter that affects a volume of audio within at least one preselected frequency band.

5. The system of claim 1, wherein the audio waves derived from the ambient sound are output by a speaker less than thirty milliseconds following receipt of the ambient sound.

6. The system of claim 1, wherein a transformation operation is altered by an individual using the mobile device and the altered transformation operation is applied to future audio waves generated from ambient sound received after the altered transformation.

7. The system of claim 1, wherein a transformation of the one or more transformation operations includes producing the audio wave with a sound pressure level higher than the sound pressure level associated with the ambient sound.

8. The system of claim 1, wherein the one of the one or more transformation operations is applied to all frequencies of the ambient sound.

9. The system of claim 1, wherein a transformation operation is applied to some frequencies of the ambient sound.

10. The system of claim 1, further comprising a user interface configured to provide an option to adjust a delay amount associated with the transformation operation.

11. The system of claim 1, wherein a transformation operation includes applying one or more filters.

12. The system of claim 1, wherein a transformation operation includes applying one or more effects.

13. The system of claim 1, wherein the series of baffles provide a plurality of air pockets and a plurality of barriers, wherein each air pocket and barrier provides an amount of passive noise attenuation.

14. The system of claim 1, wherein the ear piece comprises a first ear piece, the system further comprising:

a second ear piece, wherein the one or more transformation operations includes a stereo separation between the first ear piece and the second ear piece.

15. The system of claim 14, wherein an amount of the stereo separation is selectable according to the second user selection.

16. The system of claim 1, wherein the processor is configured to continuously adapt the active noise cancellation according to a least mean squares process.

17. A method, comprising:

converting, by an ear piece, ambient sound into digital signals, wherein the ambient sound spans an audible frequency range and the ambient sound having an ambient sound pressure level, and wherein the ear piece includes an exterior microphone, an interior microphone, and a cushion that includes a series of baffles configured to provide passive noise attenuation;

communicating with a mobile device, by a communications interface;

performing, by a processor, active noise cancellation and/or one or more transformation operations that are distinct from the active noise cancellation on the digital signals, wherein the active noise cancellation and the one or more transformation operations transform the digital signals into modified digital signals, wherein in the event the active noise cancellation is performed on the digital signals the modified digital signals have a noise cancellation sound pressure level, wherein the noise cancellation sound pressure level spans the audible frequency range and the noise cancellation sound pressure level is less than the ambient sound pressure level, wherein the noise cancellation sound pressure level is based on the passive noise attenuation provided by the cushion and active noise cancellation provided by the processor, wherein in the event one of the one or more the transformation operations is performed on the digital signals, the modified digital signals have an associated sound pressure level that spans the audible frequency range and the associated sound pressure level is less than the ambient sound pressure level and higher than the noise cancellation sound pressure level;

converting the modified digital signals into modified analog signals; and outputting the modified analog signals as audio waves, wherein an interior microphone is configured to output an output signal to the processor in response to receiving the modified analog signals, wherein in response to receiving the output signal from the interior microphone, the processor is configured to determine whether the modified digital signals produce desired audio waves and to continuously adapt the active noise cancellation and a parameter of the one or more transformation operations according to a result of the active noise cancellation and a quality of the one or more transformation operations, wherein the communications interface is configured to receive, from the mobile device, a first user selection that corresponds to selecting the one of the one or more transformation operations, wherein the communications interface is configured to receive, from the mobile device, a second user selection that corresponds to altering a selected parameter of the first user selection.

18. The method of claim 17, wherein a transformation of the one or more transformation operations includes producing the audio wave with a sound pressure level higher than the sound pressure level associated with the ambient sound.

19. The method of claim 17, wherein a transformation operation includes applying one or more filters, one or more effects, or both.

20. A computer program product, the computer program product being embodied in a tangible computer readable storage medium and comprising computer instructions for:

converting ambient sound into digital signals, wherein the ambient sound spans an audible frequency range and the ambient sound having an ambient sound pressure level, and wherein the ambient sound is converted by an ear piece that includes an exterior microphone, an interior microphone, and a cushion that includes a series of baffles configured to provide passive noise attenuation;

controlling a communications interface to communicate with a mobile device;

performing, by a processor, active noise cancellation and/or one or more transformation operations that are distinct from the active noise cancellation on the digital signals, wherein the active noise cancellation and the one or more transformation operations transform the digital signals into modified digital signals, wherein in the event the active noise cancellation is performed on the digital signals the modified digital signals have a noise cancellation sound pressure level, wherein the noise cancellation sound pressure level spans the audible frequency range and the noise cancellation sound pressure level is less than the ambient sound pressure level, wherein the noise cancellation sound pressure level is based on the passive noise attenuation provided by the cushion and active noise cancellation provided by the processor, wherein in the event one of the one or more the transformation operations is performed on the digital signals, the modified digital signals have an associated sound pressure level that spans the audible frequency range and the associated sound pressure level is less than the ambient sound pressure level and higher than the noise cancellation sound pressure level;

converting the modified digital signals into modified analog signals; and outputting the modified analog signals as audio waves, wherein an interior microphone is configured to output an output signal to the processor in response to receiving the modified analog signals, wherein in response to receiving the output signal from the interior microphone, the processor is configured to determine whether the modified digital signals produce desired audio waves and to continuously adapt the active noise cancellation and a parameter of the one or more transformation operations according to a result of the active noise cancellation and a quality of the one or more transformation operations, wherein the communications interface is configured to receive, from the mobile device, a first user selection that corresponds to selecting the one of the one or more transformation operations, wherein the communications interface is configured to receive, from the mobile device, a second user selection that corresponds to altering a selected parameter of the first user selection.

* * * * *